United States Patent [19]

Eggleston et al.

[11] Patent Number: 4,600,059

[45] Date of Patent: Jul. 15, 1986

[54] LINE MOVING APPARATUS FOR WIRELINE SUPPORTED TOOLS

[75] Inventors: Joe E. Eggleston, Missouri City; David R. Warren, Manvel, both of Tex.

[73] Assignee: Halliburton Company, Duncan, Okla.

[21] Appl. No.: 697,655

[22] Filed: Feb. 4, 1985

[51] Int. Cl.[4] ..... E21B 41/00; E21B 47/00; E21B 19/02

[52] U.S. Cl. ..... 166/385; 166/65.1; 166/72

[58] Field of Search ..... 166/385, 65 R, 381, 166/178, 106, 147, 65.1, 241, 72; 175/51, 58, 321; 285/298, 301, 302; 403/229

[56] References Cited

U.S. PATENT DOCUMENTS

| | | | |
|---|---|---|---|
| 448,903 | 3/1891 | Yorke | 403/229 X |
| 1,647,240 | 11/1927 | McDonald | 175/321 X |
| 3,354,950 | 11/1967 | Hyde | 285/302 X |

*Primary Examiner*—Stephen J. Novosad
*Assistant Examiner*—Matthew Smith
*Attorney, Agent, or Firm*—W. J. Beard

[57] ABSTRACT

For use with a wire line supported tool adapted to be run in open hole, a wire line connector to be installed between the wire line and at the top of the tool is set forth. The line moving apparatus of this disclosure preferably incorporates concentric telescoping sleeves with guide slots and cooperative protruding lugs. This apparatus attaches to the top end of a tool which is to be held stationary. This enables the supportive wire line to be continuously moved with stroking motion to thereby prevent pressure differential sticking at key seating the mud cake in the open hole.

10 Claims, 4 Drawing Figures

LINE MOVING APPARATUS FOR WIRELINE SUPPORTED TOOLS

BACKGROUND OF THE DISCLOSURE

After a well has been drilled, it is sometimes very helpful to run certain test tools in the open hole. Ordinarily, the drilling process is stopped with the hole filled with drilling mud. Moreover, a mud cake is formed against the side wall of the open hole. The mud cake more or less stratifies solids in the mud. When a test instrument is run into a well in this condition, the instrument is typically lowered to a depth where a certain tests are performed. Ordinarily, the instrument is lowered into the well and then is retrieved. The test instrument is lowered to a specified depth for performing a test. There are certain tests that require that the test tool be lowered and held at a specific elevation. Indeed, there are certain test instruments such as a multi-test tool which momentarily attach to the formation at a specified depth; the tool is operated at that elevation. When operated, it is held at a specified elevation for a period of time which may range from minutes to hours.

During the test, the test instrument is typicallly decentralized. Moreover, the wire line which supports the instrument thereabove is also decentralized. Inevitably, it is not possible to drill a well sufficiently straight and maintain the supportive wire line in the center of the open hole. Usually, the line falls over to one side or the other of the well borehole. When the wire line does move to the side, it cuts through the mud cake, and may even cut a key seat. It should be kept in mind that the open hole may well be many inches in diameter while the wire line is typically of small diameter. For instance, one industry standard wire line has a diameter of 7/16 inches.

The well will typically pass through several strata. Some of the formations may be completely impervious. That is, they may have no porosity in the rock which comprises the formation. However, some formations penetrated by the open hole may have porous materials; such porous formations may have an internal pressure which is sufficiently low that fluid migrates from the open hole into the rock formation. Migrating filtrate from the mud may flow into the zone and leave mud solids adjacent to the particular zone. In the event the supportive wire line cuts through the mud cake and lies against the side wall, there is a chance of pressure differential sticking of the cable.

Even though the cable may be quite small in diameter, it nevertheless has a specific width. This width (when multiplied by the length of cable adjacent to the low pressure zone) yields a surface area which is subject to pressure differential sticking of the wire line against the porous zone. Moreover, the flow of mud filtrate into the zone may sustain a pressure differential between the pressure in the open hole and the pressure within the zone. This creates a lateral force holding the logging cable against the key seat area and differential sticking may well occur instantly.

In the past, it has been policy to retard this by continuously raising and lowering the wire line. As a rule of thumb, the wire line is "yo-yoed" up and down approximately four feet per thousand feet of depth. Thus, if the tool at the moment is ten thousand feet deep, the wire line is yo-yoed approximately forty feet. That is, the wire line is relaxed by reeling out forty feet and then reeling in forty feet.

At the bottom end of the wire line, the test tool is fixed. Thus, the forty feet of slack typically collects near the top of the hole, and the wire line in the lower portions of the hole (just above the test instrument) is primarily static, not moving, and more readily subject to pressure differential sticking. When it sticks, it is essential to pull hard on the wire line to retrieve the equipment. If the wire line breaks, it is subsequently necessary to engage in a fishing job which is expensive and delays completion of the well.

Typically, sticking occurs just in the region above the tool because the wire line there is not moving, subject to pressure differential sticking, and not benefited by the yo-yoing of the wire line from the well head.

The apparatus of this disclosure enables the wire line to be yo-yoed from the surface and yet enables that motion to be imparted to the wire line connected to the test instrument; however, the test instrument itself is not moved. Thus, it is stationary while the wire line above is continuously moved to reduce the risk of pressure differential sticking.

With this in mind, the present apparatus is summarized as an extendable connector structure formed of two concentric sleeves and attached above a test tool. The apparatus utilizes concentric sleeves which telescope. They can be moved by reciprocating motion of the wire line. The wire line often includes electrical conductors and a suitable coiled electrical conductor is also included in this apparatus to enable the wire line conductors to communicate with the tool below the present invention.

BRIEF DESCRIPTION OF THE DRAWINGS

So that the manner in which the above-recited features, advantages and objects of the invention, as well as others which will become apparent, are attained and can be understood in detail, a more particular description of the invention, briefly summarized above, may be had by reference to the embodiments thereof illustrated in the appended drawings, which drawings form a part of this specification. It is to be noted, however, that the appended drawings illustrate only typical embodiments of this invention and are not to be considered limiting of its scope, for the invention may admit to other equally effective embodiments.

DETAILED DESCRIPTION OF THE PREFERRED EMBODIMENT

Figure 1:
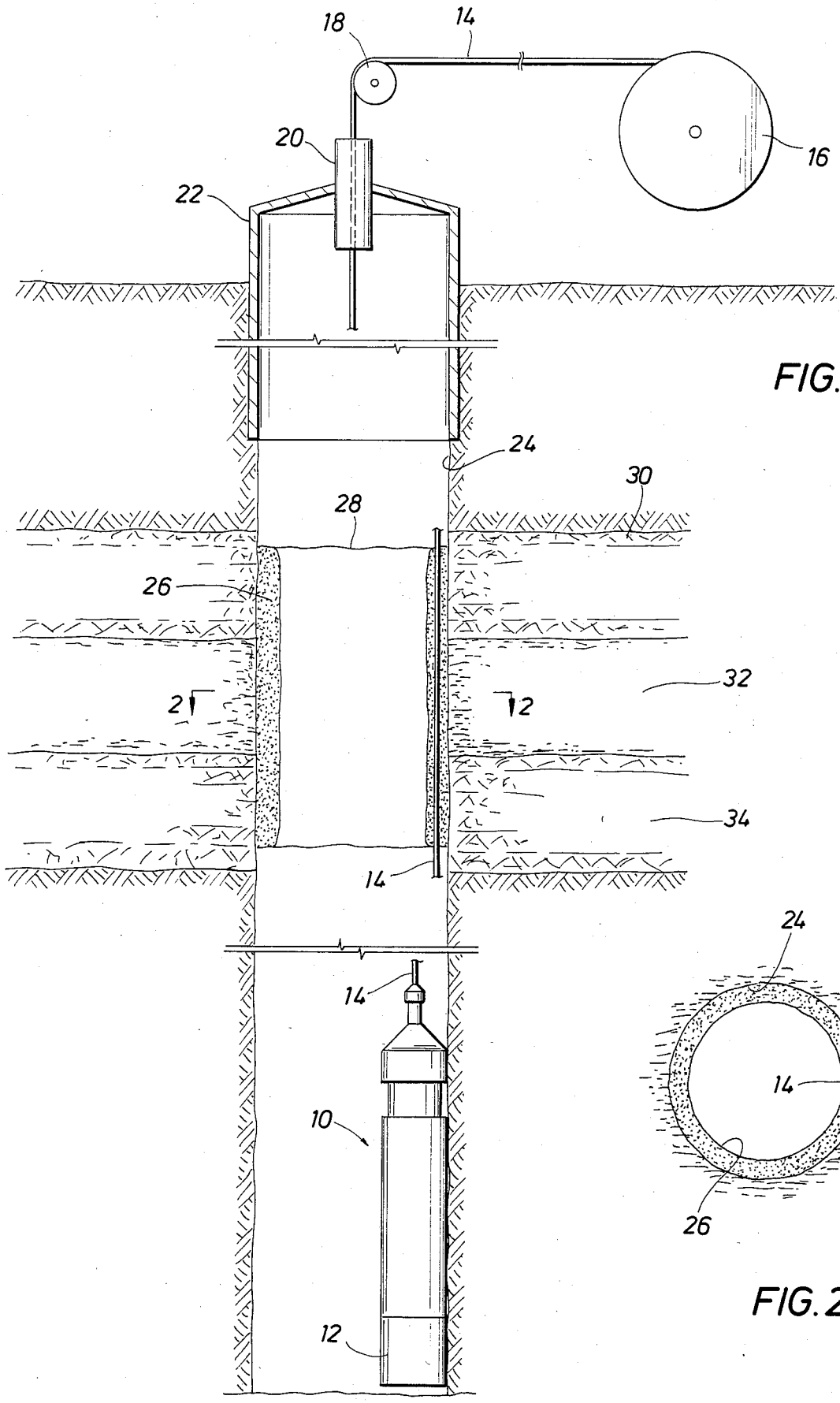
FIG. 1 shows a wire line supported tool in open hole at a specific elevation wherein the present invention has been connected between the wire line and the tool therebelow to enable the line to be moved to avoid pressure differential sticking.

Attention is directed to FIG. 1 of the drawings where the present invention is identified by the numeral 10. It is affixed to the top end of a wire line supported tool 12. The tool 12 may be of any type typically run in an open hole. As an example, it may be multi-test tool which is a fixed temporarily to a formation penetrated by an open hole whereby tests requiring stationary positioning for an interval can be performed. The test instrument 12 is the device which is held at the specified location. The line moving apparatus of this disclosure is supported on a wire line 14. The wire line may include conductors. It may be a braided or single strand line. As an example, A single strand "slick" line of 0.125 diameter is often used in the industry. More will be noted concerning the wire line 14 hereinafter.

The wire line 14 normally is deployed from a supplied drum or reel 16. It will store perhaps 20 or 25 thousand feet of the line 14. The line 14 is spooled from the drum or reel and passes over a sheave 18. It then passes through a lubricator 20 which is fixed to the well head equipment identified at 22. The lubricator enables the wire line to be inserted into the well even against pressure in the well. The well is typically open hole and hence the well head equipment 22 dose not extend full depth. The hole may be cased or uncased for a part of the length. As an example for setting forth the nature of the problem encountered, the open borehole 24 is drilled to a specific diameter to a specified depth. The borehole 24 suppots a coating of mud which is identified as the mud cake 26. Additionally, mud is found at 28. This is a standing mud column which extends up the well. The mud cake 26 is presumed to extend to the height of the column of mud. The mud cake 26 is a partially dried deposit of drilling mud solids which collects against the borehole. The thickness of the mud cake varies depending on a number of scale factors. The mud 28 is normally formed of a liquid constituent (usually water) and is mixed with the solid matter which makes the drilling mud. The mud cake typically coats the side wall while the liquid constituent bleeds into the formation. The liquid is generally described as mud filtrate. That is, the water and other liquids in the mud migrate into the adjacent formations.

To set forth an example of the problem typically encountered, the numeral 30 identifies a strata or formation which is not porous and which does not accept filtrate. The numeral 32 identifies a porous formation. Conveniently, it is adjacent to another formation 34 which is impervious. The porous formation 32 is fluid isolated by the mud cake 26 after the mud cake has been formed. Thus, after the initial surge of filtrate entering the formation 32, flow is normally stopped because the mud cake coats the open borehole 24 and prevents indefinite flow of filtrate into the formation. Then, the formation 32 is isolated, meaning that the flow of liquid into the formation is curbed. As long as the mud cake 26 is substantially undisturbed, no particular problem subsequently arises. However, if the mud cake 26 were stripped away completely, more filtrate would flow into the formation for an interval until the mud 26 were again built up. Thus, the mud cake 26 serves a useful purpose, namely, preventing excessive flow of drilling fluids into the adjacent formation.

Figure 2:
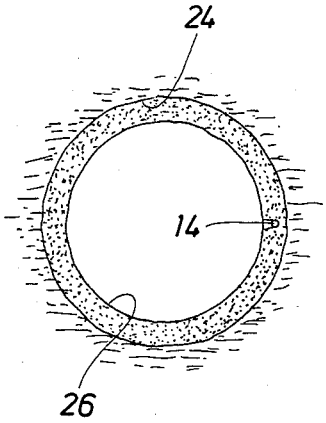
FIG. 2 is a sectional view along the line 2—2 of FIG. 1 showing pressure differential sticking of the wire line.

The wire line 14 will inevitably lay against one side or the other of the open hole 27. It is relatively thin and functions almost as a knife edge to cut into the mud cake 26. As shown in FIG. 2 of the drawings, the mud cake 26 is more or less cut by the wire line 14. That is, it cuts through the mud cake until it forms a key seat in the profile of the open hole 24. This tends all the more to hold the wire line 14 against the side wall of the open hole 24.

Once the mud cake has been cut, there will be subsequent flow of mud filtrate into the adjacent formation. That is, the cut in the mud cake 26 is subsequently repaired as additional mud cake deposits at that area while a small portion of the filtrate flows into the adjacent formation. The measure of sticking force applied laterally to the wire line varies with the thickness of the formation 32. Thus, a formation which is one hundred feet thick will provide approximately one hundred times the lateral sticking force on the wire line. While the wire line is quite strong and able to stand a pull of 10 thousand pounds for a wire line of 7/16 diameter, if the formation 32 is quite thick, or if the pressure differential is quite high, the lateral loading may be so great as to literally clamp the wire line against the side of the borehole 24 and to hold it. This clamping force applied laterally may be so great that pulling on the wire line will break the line 14.

As described earlier, yo-yoing the wire line keeps it moving. Thus, at the formation 32, continued reciprocation of the wire line cuts down the sticking force because it re-lubricates the immediate area where the wire line cuts into the mud cake and continually introduces filtrate around the wire line so as to lubricate and the free the wire 14. As observed earlier, if the wire line does not move, and particularly at that stationary portion just above the test instrument, likelihood of pressure differential sticking increases just above the test instrument.

Figure 3:
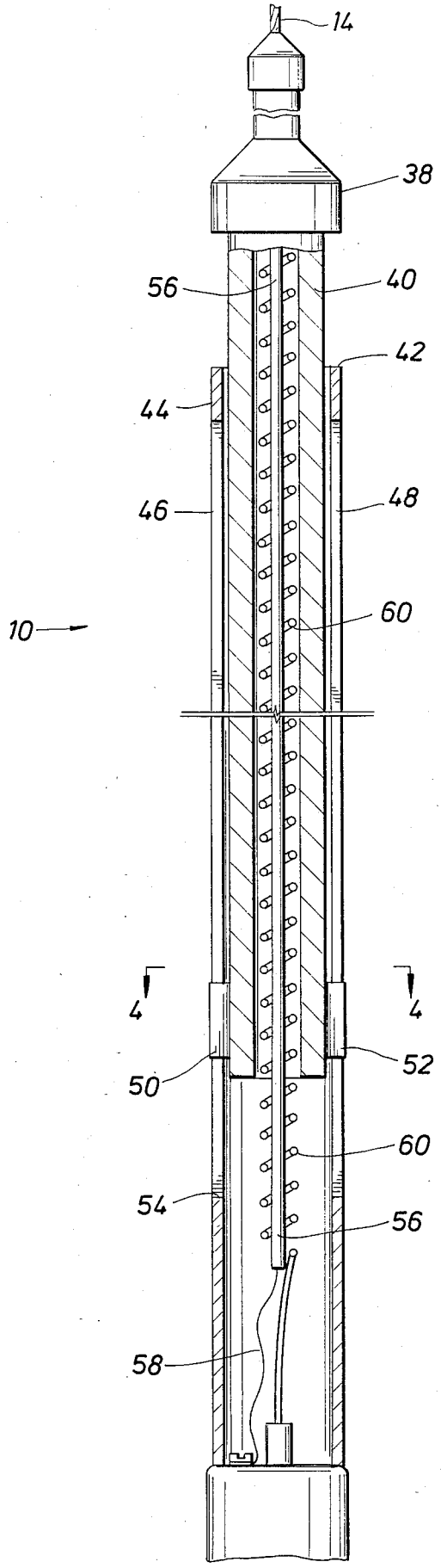
FIG. 3 is a detailed sectional view along the length of the line moving apparatus of this disclosure which is typically affixed to a top of a test tool.
Figure 4:
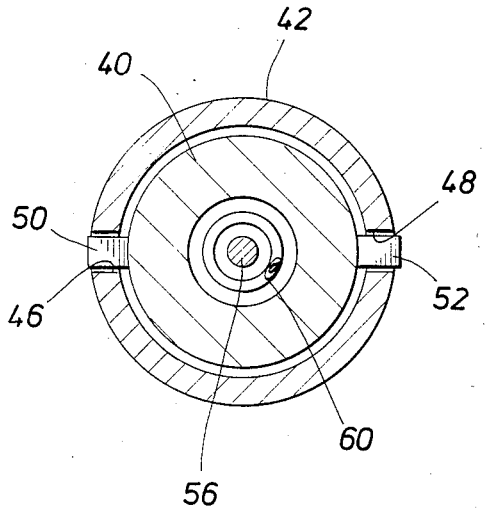
FIG. 4 is a sectional view along the line 4—4 of FIG. 3 showing details of construction of concentric sleeves which telescope during operation of a line moving apparatus of this disclosure.

The line moving apparatus 10 is interposed between the wire line 14 and the test instrument 12 which is supported therebelow. Attention is momentarily directed to FIGS. 3 and 4 for description of this apparatus. In FIG. 3 of the drawings, the numeral 14 again indicates the wire line which is connected to a fishing neck 38. This enables easy retrieval of the equipment should it become stuck. The fishing neck 38 is affixed to a telescoping sleeve 40. The sleeve 40 is the smaller of two sleeves, the second sleeve being identified by the numeral 42. The sleeve 42 is larger. It is formed with a full circle portion at 44. First and second opposing slots are cut at 46 and 48. The slots 46 and 48 are better seen in FIG. 4 of the drawings. There, it will be observed that protruding matching lugs 50 and 52 extend into the slots 46 and 48. These lugs guide the telescoping sleeves; that is, the limited stroke of the equipment is defined by the lugs 50 and 52 received in the slots 46 and 48. Upward travel is limited by the full ring construction 44. Downward travel is limited by the bottom terminus of the slots at 54.

The line moving apparatus includes the sleeve 40. It is preferably axially hollow. A rod 56 is centered in the sleeve 40. The rod 56 preferably extends approximately to the bottom of the sleeve 40. To avoid pulling the equipment apart, the lower end of the rod 56 is anchored by a safety wire 58. This prevents excessive extension. There is an annular space around the rod 56 inside the sleeve 40. The annular space receives a coiled electrical conductor 60. The conductor 60 is able to elongate or compress. The coiled conductor 56 in the annular space thus accommodates variations in the length of the equipment as it reciprocates.

As a suggested scale of the equipment, the slots 46 and 48 have a length of about four feet to thereby permit a stroke of four feet. The entire length of the tool in the compressed state is about five feet and can telescope to about nine feet in one embodiment. Needless to say, the device can be scaled to longer or shorter sizes as needed.

This apparatus is used in the following manner. The line moving apparatus 10 is installed above the test instrument. The test instrument is run into a well and is located at a suitable elevation. It is operated to fix itself at a specified depth in the well and maintains this location for an interval. At this juncture, pressure differential sticking is avoided by yo-yoing the wire line 14 by continuously driving the reel 16. The amount of extension and retraction is typified above. The wire line is yo-yoed back and forth; this prevents pressure differential sticking. This apparatus enables that yo-yoing motion to be conveyed all the way along the wire line from top to bottom. That is, even the wire line just a few feet above the test instrument 12 is moved back and forth to avoid pressure differential sticking. This apparatus enables a stroke of about four feet in one embodiment. A stroke of four feet of the wire line enables sufficient back and forth sliding to prevent sticking.

After the tool has completed its operation, it can be subsequently removed by pulling on the wire line. It only provides up to about four foot of elongation at the time of retrieval.

This apparatus is preferrably installed on tools which might be left at a bottom elevation for any period of time.

The foregoing is directed to the preferred embodiment, the scope is determined by the claims which follow.

What is claimed is:

1. Open hole well servicing equipment, comprising:

(a) an elongate wireline;

(b) means for raising and lowering the elongate wireline in an open hole;

(c) a tool adapted to perform downhole services when suspended in an open hole; and (d) means connected between said wireline and said tool enabling relative movement of said wireline connected to said means through a specified stroke, said means enabling said tool to sustain a specified elevation within an open hole while said means for raising said wireline operates to reciprocate said wireline.

2. The apparatus of claim 1 wherein said connected means elongates by movement of first and second telescoping sleeves.

3. The apparatus of claim 2 wherein said wireline is connected at an upper of one of said first or second sleeves.

4. The apparatus of claim 3 wherein said sleeves are:

(a) concentric of one another;

(b) limited in stroke by engaging lugs and slots on said sleeves; and (c) connected to said wireline and said tool.

5. A method of operating an well tool in an open hole well comprising the steps of:

(a) lowering a tool into a well on a wireline;

(b) conducting below ground well operations with said tool set at a specified elevation;

(c) while the prior step is being conducted, reciprocating the wireline up and down from the top of the well to keep the wireline in continuous motion; and (d) wherein the last step is conducted substantially along the entire length of the wireline including enabling the lower end of the wireline to move as a result of reciprocation of the wireline by means connected between said wireline and said tool at the lower end of said wireline, said means having a specified stroke and enabling said tool to sustain a specified elevation in the borehole while said means operates to allow reciprocal motion of said wireline.

6. The method of claim 5 wherein the step of reciprocating includes reeling the wireline into and out of the well by rotating a drum with one end of the wireline spooled thereon.

7. The method of claim 6 wherein the steps of reeling the wireline includes rotating repetitively the drum to provide a reciprocation of specified length.

8. The method of claim 6 wherein the step of reciprocating extends wireline into the well about four feet per thousand feet of well to said tool.

9. The method of claim 5 wherein the lower end of the wireline is raised and lowered by a specified length defined by reciprocating movement of means having a sleeve affixed to said tool and a second sleeve telescoping with said first sleeve.

10. The method of claim 9 wherein said sleeves are limited in stroke; and the reciprocating step moves the sleeves through the limited stroke.

* * * * *